US011619088B2

(12) United States Patent
Bacchetti

(10) Patent No.: US 11,619,088 B2
(45) Date of Patent: Apr. 4, 2023

(54) LINEAR ACTUATOR, AS WELL AS CLOSING/OPENING SYSTEM THAT INCLUDES SUCH ACTUATOR

(71) Applicant: IN & TEC S.R.L., Brescia (IT)

(72) Inventor: Luciano Bacchetti, Nave (IT)

( * ) Notice: Subject to any disclaimer, the term of this patent is extended or adjusted under 35 U.S.C. 154(b) by 715 days.

(21) Appl. No.: 16/480,217

(22) PCT Filed: Feb. 2, 2018

(86) PCT No.: PCT/IB2018/050667
§ 371 (c)(1),
(2) Date: Jul. 23, 2019

(87) PCT Pub. No.: WO2018/142338
PCT Pub. Date: Aug. 9, 2018

(65) Prior Publication Data

US 2019/0368258 A1 Dec. 5, 2019

(30) Foreign Application Priority Data

Feb. 2, 2017 (IT) ..... 102017000011597
Feb. 2, 2017 (IT) ..... 102017000011628

(51) Int. Cl.
*E05F 15/56* (2015.01)
*E05F 1/16* (2006.01)

(52) U.S. Cl.
CPC ..... *E05F 15/56* (2015.01); *E05F 1/16* (2013.01); *E05Y 2201/478* (2013.01); *E05Y 2900/132* (2013.01)

(58) Field of Classification Search
CPC ..... E05F 1/16; E05F 15/56; E05Y 2201/478
See application file for complete search history.

(56) References Cited

U.S. PATENT DOCUMENTS 8,051,534 B1 * 11/2011 Luca ..... E05F 3/02 16/84
8,439,098 B1 * 5/2013 Jones ..... E05F 1/16 160/180
8,601,742 B2 * 12/2013 Domholt ..... F15B 15/18 49/140
9,435,152 B2 * 9/2016 Zimmer ..... E05F 1/16
11,225,816 B2 * 1/2022 Gayhart ..... E05F 15/635
2019/0390496 A1 * 12/2019 Bacchetti ..... E05F 1/16

FOREIGN PATENT DOCUMENTS

DE 202005017068 4/2006
DE 202005001524 6/2006
GB 820818 9/1959

* cited by examiner

*Primary Examiner* — Jeffrey O'Brien
(74) *Attorney, Agent, or Firm* — Themis Law

(57) ABSTRACT

A linear actuator includes a jacket defining an axis and a rod having an end cylinder tightly slidable in the jacket and an opposite end sliding between a rest position and a working position. The end cylinder divides the jacket into a first and a second variable volume compartments fluidly independent from each other, one of them being fluidly insulated and under vacuum, the other one being fluidly communicating with the outside environment. Upon the passage of the opposite end of the rod from the rest position to the working position, one of the variable volume compartments passes from a minimum volume to a maximum volume, in order to suck the rod and automatically recall the opposite end from the working position to the rest position.

11 Claims, 6 Drawing Sheets

LINEAR ACTUATOR, AS WELL AS CLOSING/OPENING SYSTEM THAT INCLUDES SUCH ACTUATOR

FIELD OF THE INVENTION

The present invention is generally applicable to the technical field of the moving systems, and particularly relates to a linear actuator.

The invention further relates to a system for opening/closing an aperture including such an actuator.

STATE OF THE ART

It is known that there are two main kinds of linear actuators, hydraulic or pneumatic ones.

In both cases, the actuator must be connected to a supply line of a working fluid, either oil or compressed air.

This implies the undoubted drawback of having a working fluid to manage, with all the related problems. As a consequence, these kinds of actuators are unsuitable for several non-industrial applications, for example the movement of a sliding door or a door leaf.

Compression and traction gas springs are known too. In these kinds of springs a gas, generally nitrogen, is used to bring the rod back to its rest position once it is pushed or pulled into the working position.

A known drawback of these kinds of springs is that they tend to discharge over time, forcing them to be periodically replaced. Moreover, since the rod works against a gas as the rod is compressed or pulled, the pressure of the gas increases, and as a result the force necessary to move the rod increases.

SUMMARY OF THE INVENTION

The object of the present invention is to overcome at least partially the above drawbacks, by providing a linear actuator having characteristics of high functionality, simplicity of construction and being low cost.

Another object of the invention is to provide a linear actuator which always requires the same force to move the rod independently of its position.

Another object of the invention is to provide a linear actuator which requires minimum maintenance.

Another object of the invention is to provide a linear actuator of limited overall dimensions.

Another object of the invention is to provide an actuator which ensures the automatic closing/opening of a door or of a door leaf from the open/closed position.

Another object of the invention is to provide a linear actuator which ensures the controlled movement of the closing element to which it is connected.

Another object of the invention is to provide a linear actuator which has a minimum number of constituent parts.

These objects, as well as other objects which become more apparent hereinafter, are fulfilled by a linear actuator in accordance with what is herein described, illustrated and/or claimed.

The linear actuator may comprise at least one jacket defining an axis and at least one rod having an end cylinder reciprocally tightly slidable in relation to the at least one jacket along the axis between a rest position and a working position.

The end cylinder can divide the at least one jacket in at least one first and second variable volume compartments fluidically independent to each other, one of the at least one first and second variable volume compartments being able to be insulated and vacuum-sealed, the other of the at least one first and second variable volume compartments being able to be fluidically communicating with the external environment.

Upon the passage of the end cylinder from the rest position to the working position, one of the at least one first and second variable volume compartments may expand, so as to suck the end cylinder from the working position to the rest position by automatically recalling the at least one rod.

Preferably, in said linear actuator, the minimum volume of one of at least one first and second variable volume compartments may be substantially zero, as well as its internal pressure.

Preferably, in said linear actuator the at least one jacket may include one side wall and a pair of end walls, the end cylinder in the rest position being substantially in contact with one of the end walls.

Preferably, in said linear actuator the jacket may include a tubular element defining the side wall and an end cap reciprocally tightly coupled with the tubular element, the end cap including one of the end walls, the at least one rod and the tubular element being reciprocally configured so that upon the mutual coupling of the end cap and the tubular element one of the end walls and the end cylinder are in mutual contact, so as to ensure that one of the at least one first and second variable volume compartments is substantially under vacuum.

Preferably, in said linear actuator the at least one rod may further include an end opposite to the end cylinder externally slidable with respect to the at least one jacket along the axis between a position proximal to the at least one jacket, corresponding to one of the rest and working position of the end cylinder, and a position distal from the at least one jacket, corresponding to the other of the rest and working position of the end cylinder.

Preferably, in the above mentioned linear actuator one of the end walls may be a bottom wall, the other of the end walls may be an opposite wall having a passing-through opening for the passage of the at least one rod, one of the at least one first and second variable volume compartments being able to include the bottom wall, the proximal position of the opposite end of the at least one rod corresponding to the rest position of the end cylinder.

Preferably, in said linear actuator in/from said other of said at least one first and second variable volume compartments an air flow from/to the outside environment can flow.

Preferably, in said linear actuator upon the passage of said end cylinder from said rest position to said working position said other of said at least one first and second variable volume compartments may retract by blowing off air towards the outside environment, upon the sucking of said end cylinder from said working position to said rest position, the other one of said at least one first and second variable volume expanding by sucking air from the outside environment.

Preferably, said linear actuator may further comprise means for controlling the air flow flowing in/out from the other of said at least one first and second variable volume compartments to control the force necessary for the passage of said end cylinder from said rest position to said working position and/or to control the suction speed thereof from said working position to said rest position.

Preferably, in said linear actuator the control means may include:

- a first and second line for the fluidic connection with the outside environment of said other of said at least one first and second variable volume compartments;

valve means selectively acting on one of said first and second fluid connecting lines to open it upon the passage of said end cylinder from said rest position to said working position and to close it upon the reverse passage, so as to force the air to flow in said other of said at least one first and second variable volume compartments through the other of said first and second fluid connecting lines.

Preferably, in the above mentioned linear actuator the control means may also include adjusting means acting on said other of said first and second fluid connecting lines to adjust the flow passage section.

Preferably, in said linear actuator the other of said first and second fluid connecting lines may include at least one duct, said adjusting means including an adjusting grain having an operating end accessible from outside by an operator and a working end acting on said at least one duct.

In a further aspect, regardless of the configuration of the above mentioned linear actuator, a flow control unit for a working fluid may be provided in accordance with what is described, illustrated and/or claimed herein.

The control unit for controlling the flow of a working fluid may be coupleable to a linear actuator, which may include at least one jacket defining an axis and at least one rod having an end cylinder reciprocally tightly slidable in relation to the at least one jacket along the axis between a rest position and a working position.

In the flow control unit mentioned above, the end cylinder can divide the at least one jacket in at least one first and second fluidically independent variable volume compartments. One of the at least one first and second variable volume compartments may be fluidically communicating with the outside environment.

The control unit may include a first and second lines for the fluidic connection of one of the at least one first and second variable volume compartments with the outside environment and valve means selectively acting on one of the first and second fluid connecting lines to open it upon the passage of the end cylinder from the rest position to the working position and to close it upon the reverse passage.

In this way, it may be possible to force the air to flow into the other of said at least one first and second variable volume compartments through the other of the first and second fluid connecting lines.

Preferably, the flow control unit mentioned above may further comprise adjusting means acting on said other of said first and second fluid connecting lines to adjust the flow passage section.

Preferably, in said flow control unit the other of said first and second fluid connecting lines may include at least one duct, said adjusting means including an adjusting grain having a control end accessible from outside by an operator and a working end acting on said at least one duct.

A linear actuator may be also provided, including the control unit for controlling the flow of a working fluid mentioned above.

In particular, this linear actuator may include:

at least one jacket defining an axis;

at least one rod having an end cylinder reciprocally tightly slidable in relation to said at least one jacket along said axis between a rest position and a working position;

means for controlling the air flow flowing in/out from said one of said at least one first and second variable volume compartments to control the force necessary for the passage of said end cylinder from said rest position to said working position and/or to control the suction speed thereof from said working position to said rest position;

wherein said end cylinder divides said at least one jacket in at least one first and second variable volume compartments fluidically independent to each other, one of said at least one first and second variable volume compartments being fluidically communicating with the outside environment;

wherein said means of control include or consist of the control unit mentioned above.

Preferably, in the actuator including the control unit mentioned above, said one of said at least one first and one second variable volume compartments can flow an air flow from/to the outside environment.

Preferably, in the actuator including the control unit mentioned above upon said end cylinder passes from said rest position to said working position said one of said at least one first and second variable volume compartments may retract by blowing off air towards the outside environment, upon the passage of said end cylinder from said working position to said rest position said one of said at least one first and second variable volume compartments can expand by sucking air from the outside environment.

Preferably, in the actuator including the control unit mentioned above, the linear actuator may have one or more of the mentioned characteristics.

BRIEF DESCRIPTION OF THE DRAWINGS

Further features and advantages of the invention will be more evident considering the detailed description of some preferred but not exclusive embodiments of a linear actuator 1, shown by way of a non-limiting example with the aid of the accompanying drawings, wherein.

DETAILED DESCRIPTION OF SOME PREFERRED EMBODIMENTS

With reference to the mentioned figures, a linear actuator 1 is described, adapted to linearly move any object, mechanism or system. The linear actuator can act directly or indirectly, by means of pulleys or referral mechanisms.

In a preferred but not exclusive embodiment of the invention, the linear actuator 1 can be used in a system 100 for closing/opening an aperture P by means of a closing element D movable between an open position and a closed position.

In general, the aperture P may be any opening made in any stationary supporting structure, and the closing element D may be any such, for example a door, a door leaf, a hatch, a trap-door or similar. Likewise, the closing element D can move with any motion, rectilinear along a sliding plane or rotary around a rotation axis.

Figure 1A:
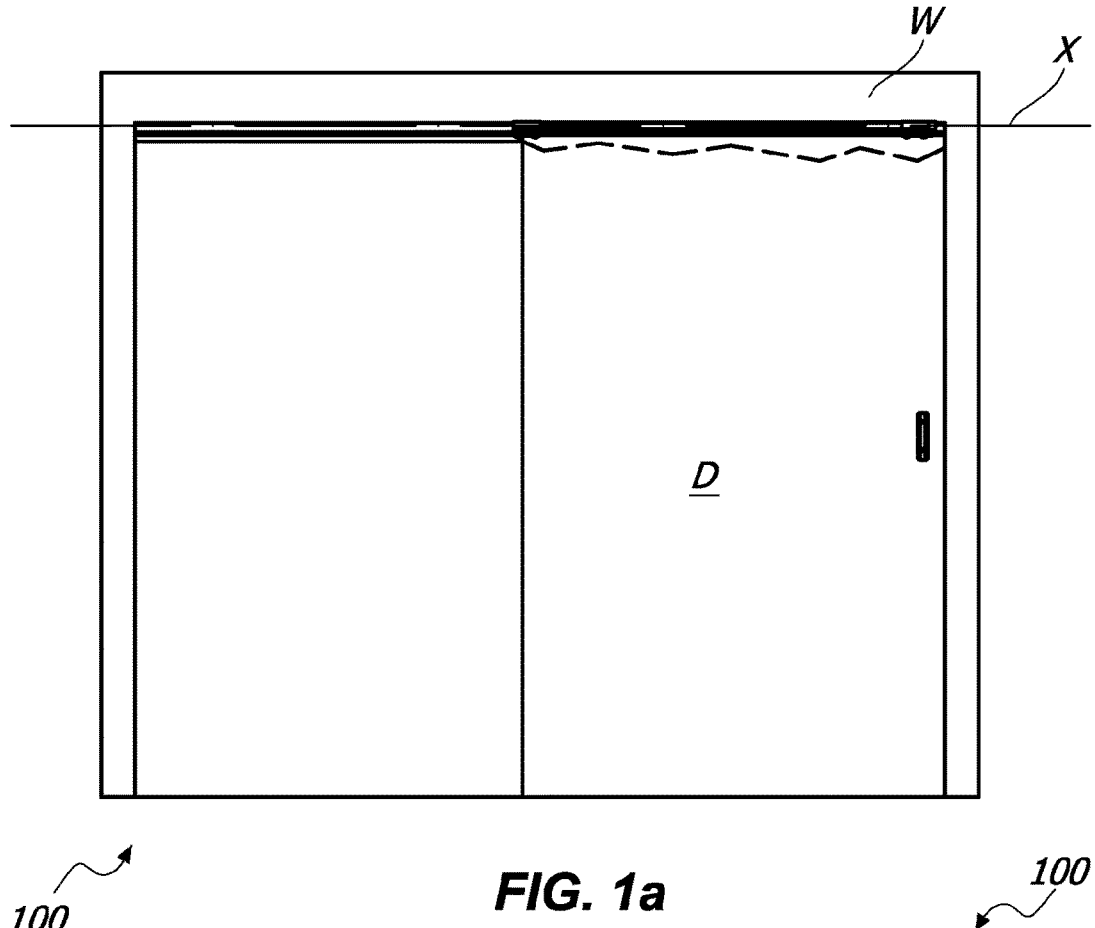
FIGS. 1*a* and 2*a* are schematic views of an embodiment of the system 100 for closing an aperture P by means of a sliding door D moved by a preferred non-exclusive embodiment of a linear actuator 1, respectively in the closed door position D and the open door D.
Figure 2A:
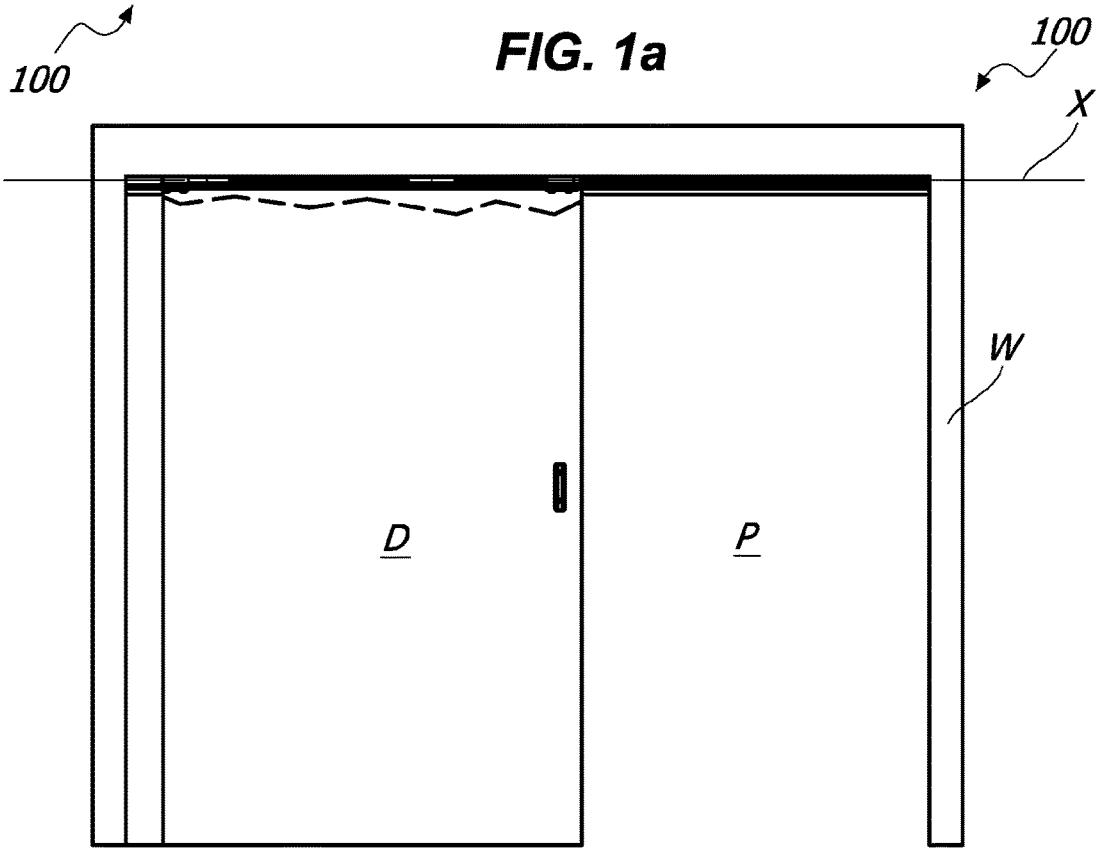
Figures 1B, 2B, 3:
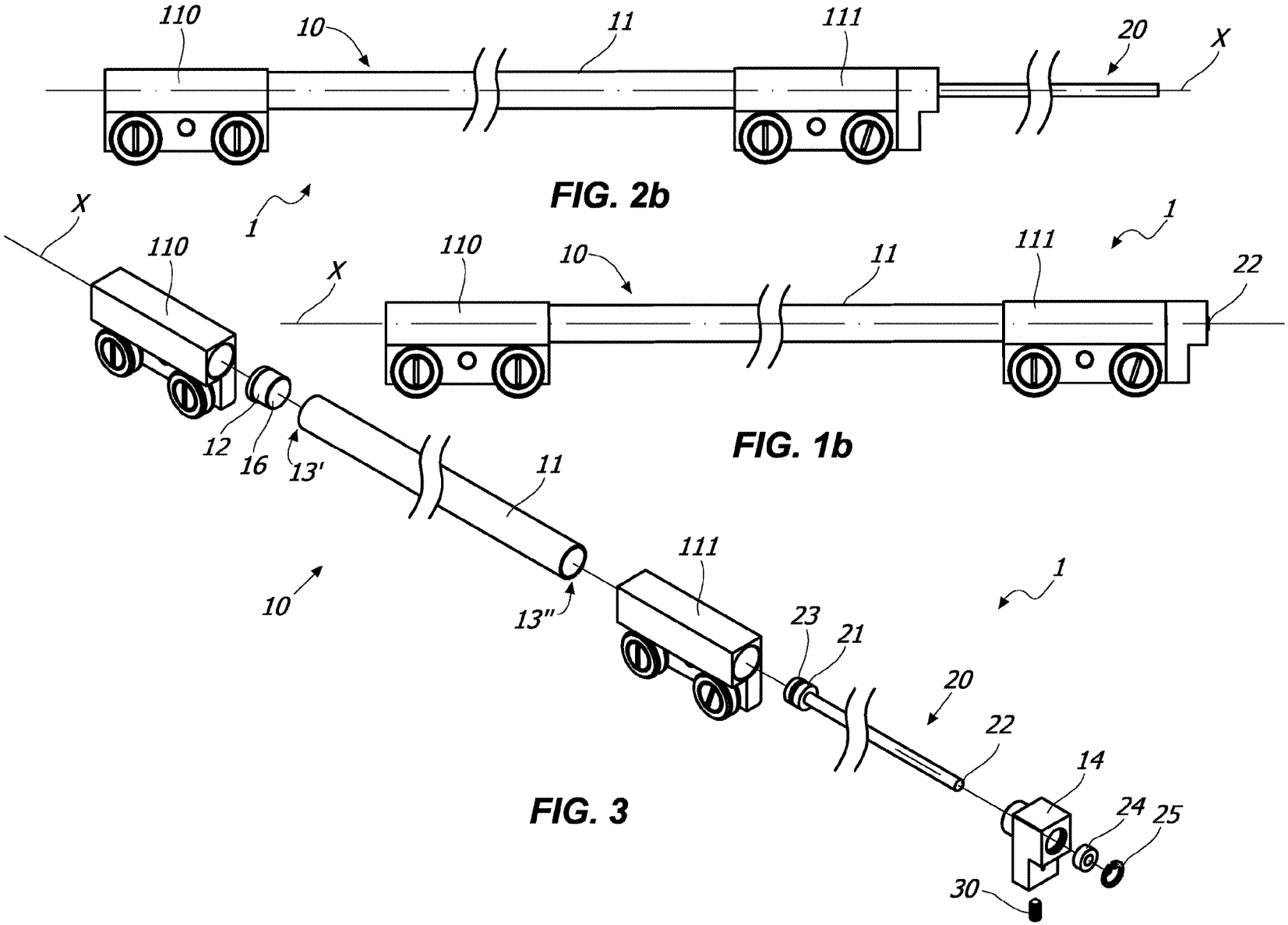
FIGS. 1*b* and 2*b* are schematic views of the embodiment of the linear actuator 1 of FIGS. 1*a* and 2*a* respectively in the closed door position D and open door D.
FIG. 3 is an exploded view of the embodiment of the linear actuator 1 of FIGS. 1*a* and 2*a;*

For example, as illustrated in FIGS. 1*a* and 2*a*, the aperture P may be a passage made in a wall W, and the closing element D may be a sliding door in a plane defined by the door itself between a closed position, shown in FIG. 1*a*, and an open position, illustrated in FIG. 2*a*. FIGS. 1*b* and 2*b* respectively show the linear actuator 1 in the positions corresponding to those of FIGS. 1*a* and 2*a*.

In general, the linear actuator 1 may comprise a jacket 10 defining an axis X and a rod 20 movable therefrom between a retracted position, illustrated for example in FIG. 1*b*, and an extended position, illustrated for example in FIG. 2*b*.

Even if, in the following, the jacket 10 is described as a movable element with respect to the stationary rod 20, it is understood that the opposite can also occur, i.e. the rod may move in relation to the stationary jacket, without thereby exceeding the scope of protection of the appended claims.

It is also understood that even if in the illustrated embodiments a single rod 20 and a single jacket 10 are provided, the linear actuator 1 may include a plurality of jackets and/or a plurality of rods, as it can be coupled to other actuators, for example gas springs of a known type, without thereby exceeding the scope of protection of the appended claims.

In any case, the mobile element of the linear actuator 1, the jacket 10 in the embodiment illustrated in the appended figures, may be connected to the sliding door D, while the stationary element, the rod 20 in the embodiment illustrated in the appended figures, may be fixed to the wall W.

Therefore, the jacket 10 will slide unitary with the door between the open and closed positions thereof.

For this purpose, slider means may be provided, for example two or more slides 110, 111, operatively engaged in one or more guiding rails 120 defining a sliding direction d substantially parallel to the axis X defined by the jacket.

Advantageously, the slides 110, 111 can be coupleable to the tubular element 11 of the linear actuator 10, for example slidably inserted thereon.

In this way, a compact, simple to realize and functional linear actuator is obtained.

These features allow it to be retractable into a lengthened or C-shaped inferiorly opened tubular 130, which can be inserted into the door frame or into a false ceiling, or be an integral part of them.

Preferably, the profile 130 with the linear actuator 1 may be positioned above a sliding door D. On the other hand, it may also be positioned laterally to the door D or even below it, using suitable return means such as for example pulleys and ropes.

The linear actuator 1 usable in the system 100 may be of any type. Preferably, it will be a pneumatic type, for example a gas spring of a known type.

In a preferred but not exclusive embodiment of the system 100, the actuator 1 may have the characteristics described below.

Even if in the rest of the description a linear actuator 1 is described for moving the sliding door D, it is understood that the linear actuator 1 can have any use without thereby exceeding the scope of protection of the appended claims.

As mentioned above, in the present description the notion of sliding between the rod 20 and the jacket 10 and the relative parts must be understood in a relative and not absolute manner. Therefore, even if for simplicity the sliding of the rod 20 with respect to the jacket 10 is to be cited, it must be understood that the sliding between these parts is reciprocal and relative to each other.

In the embodiment illustrated in FIGS. 1 to 5 the retracted position of FIG. 1*b*, corresponding to the closed door position D, corresponds to the rest position of the linear actuator 1, i.e. the one in which the linear actuator 1 itself is not stressed by external forces.

On the other hand, the extended position of FIG. 2*b*, corresponding to the open door position D, corresponds to the working position of the linear actuator 1, i.e. the one wherein the linear actuator 1 is stressed by the force that the user gives to the door to open it. From this position the linear actuator 1 automatically closes the door D, or, what is the same, the linear actuator 1 automatically returns to its rest position.

In this embodiment, therefore, the linear actuator 1 works in traction.

Advantageously, the rod 20 may include an end cylinder 21 and an opposite end 22, both naturally tightly slidable with each other along the axis X by the rod 20. The end cylinder 21, therefore, will slide between the rest and working positions.

The end cylinder 21 may tightly slide inside the jacket 10 by means of a gasket 23, of a known type. The opposite end 22 may slide outwardly of the jacket 10 between a position proximal to this, corresponding to the rest position shown in FIG. 1*b*, and a distal position thereof, corresponding to the working position shown in FIG. 2*b*.

The jacket 10 may include a tubular element 11 defining the side wall thereof, an end cap 12 tightly screwed at the end 13' of the tubular element 11 and a closing element 14 tightly screwed at the other end 13" of the tubular element 11.

The rod 20 may be inserted through an opening 15 passing through a wall 14' of the closing element 14.

Figure 4A:
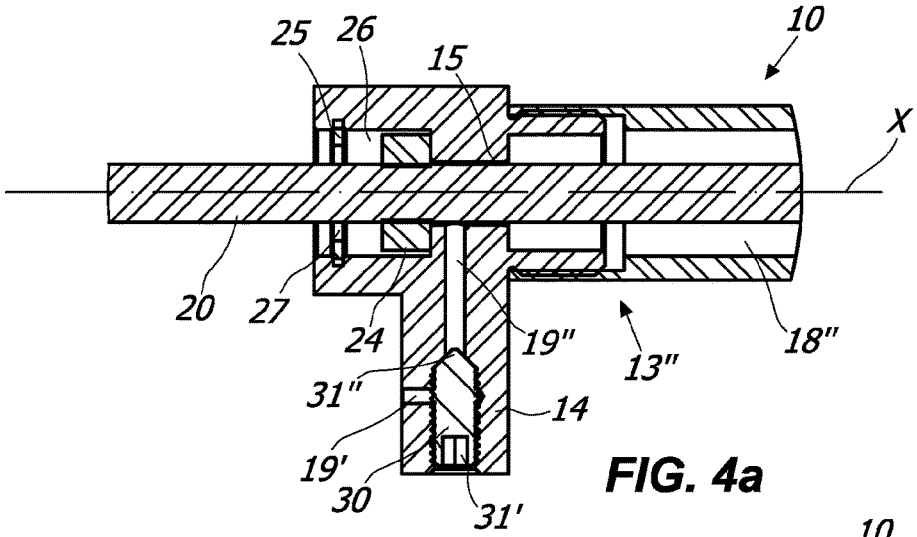
FIGS. 4*a* and 4*b* are respectively views in section of the ends 13" and 13' of the tubular element 11 of the embodiment of the linear actuator 1 of FIGS. 1*a* and 1*b* in the closed door position D.
Figure 4B:
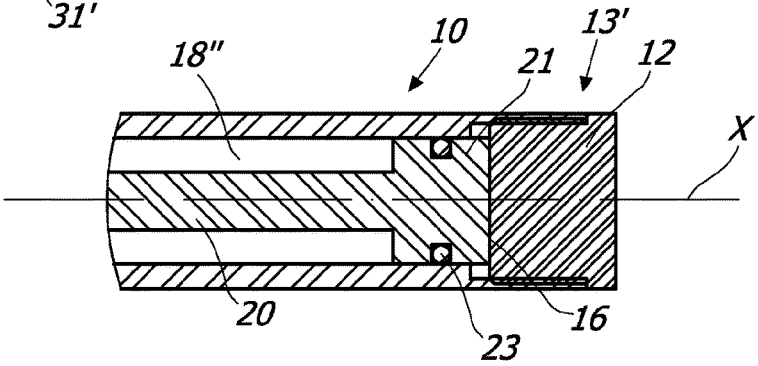
Figure 5:
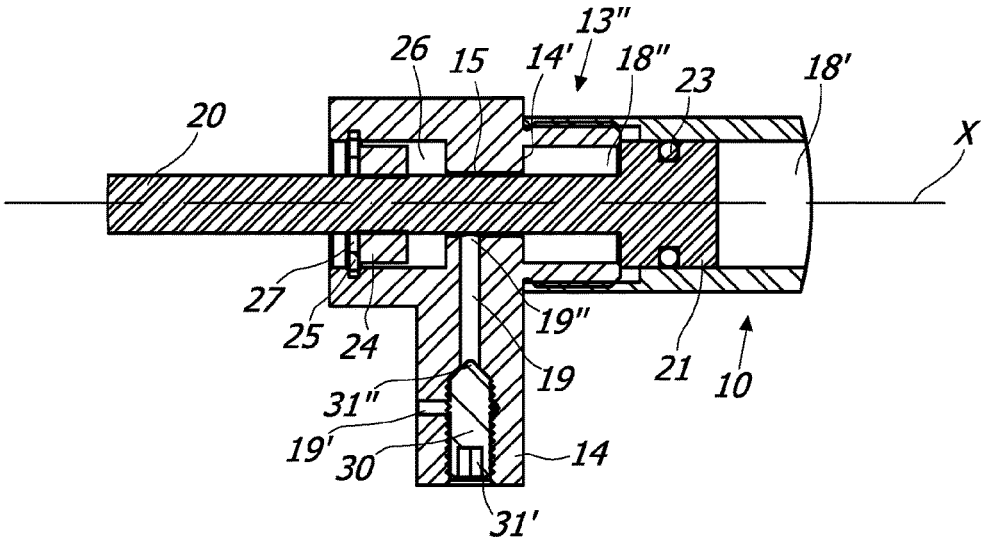
FIG. 5 is a sectional view of the end 13" of the tubular element 11 of the embodiment of the linear actuator 1 of FIGS. 2*a* and 2*b* in the open door position D.

Advantageously, the rod 20 and the tubular element 11 may be mutually configured so that when the end 22 is in the proximal rest position, illustrated for example in FIG. 1*b*, the bottom wall 16 of the end cap 12 contacts the end cylinder 21, as particularly illustrated in FIG. 4*b*.

The end cylinder 21 may divide the jacket 10 into a first and second variable volume compartments 18', 18" fluidically independent to each other, i.e. compartments which are not fluidically connected to each other and which don't exchange any fluid.

When the end 22 is in the rest position, as illustrated for example in FIG. 1*b*, the variable volume compartment 18' has the minimum volume while the variable volume compartment 18" has the maximum volume, while the opposite occurs when the end 22 is in the working position, as illustrated for example in FIG. 2*b*.

Since the end cap 12 is tightly screwed into the tubular element 11 and the end cylinder 21 is tightly inserted in the latter, the compartment 18' is fluidically insulated, i.e. any fluid can't enter/exit in/from the same.

On the other hand, since when the end 22 is in the rest position, illustrated for example in FIG. 1*b*, the bottom wall 16 of the end cap 12 is in contact with the end cylinder 21, as particularly illustrated in FIG. 4*b*, the compartment 18' is under vacuum. In this position, therefore, the volume of the compartment 18', corresponding to its minimum volume, is substantially zero, like the pressure inside it.

To this end, the screwing of the end cap 12 may take place when the end cylinder 21 is already at the end 13' of the tubular element 11. This occurs when the end 22 is in the proximal rest position, illustrated for example in FIG. 1*b*. By inserting the end cylinder 21 through the end 13", in fact, it is possible to substantially expel all the air from the compartment 18', which is then plugged with the end cap 12.

In this way, it is ensured that the compartment 18' remains under vacuum without the aid of external vacuum pumps or means.

It is understood, however, that it may be possible to place the compartment 18' under vacuum in any way, for example by connecting it to external pumps or vacuum means, without thereby departing from the scope of protection of the appended claims.

Advantageously, the compartment 18" may be fluidically communicating with the outside environment. In this way, the compartment 18" may be at atmospheric pressure, that is at the pressure of the outside environment.

For the above, in the closed door position shown in FIG. 1*a* the end cylinder 21 remains against the bottom wall 16 of the end plug 12, and therefore the end 22 remains in the rest position proximal to the jacket 10.

Once a user opens the sliding door D, i.e. upon the passage of the end 22 from the rest position proximal to the jacket 10 to the working position distal therefrom, the compartment 18' expands increasing in volume up to a maximum volume, while the compartment 18" contracts decreasing in volume up to a minimum volume.

In doing so, the user works against the vacuum present in the compartment 18', which guarantees that the same force will always be required to open the sliding door D regardless of its position. At the same time, the compartment 18" discharges the air present therein into the outside environment.

Once the user leaves the door D in the open position, the vacuum present in the compartment 18' will suck the rod 20 automatically recalling the end 22 towards the rest position proximal to the jacket 10, returning the end cylinder 21 against the end cap 12 and automatically closing the sliding door D. As a consequence, the compartment 18" will be charged with air coming from the outside environment.

Due to the fact that the compartment 18' is considered empty, the linear actuator 1 guarantees the constancy of the force required to open/close the door D from its position.

It is also evident that the linear actuator 1 is extremely functional and it's simple and economical to build and assemble.

In fact the assembly will take place as described above by inserting the rod 20 through the tubular element 11, screwing the end cap 12 at the end 13' of the latter as mentioned above to obtain an under vacuum compartment 18', and screwing the closing element 14 in correspondence of the opposite end 13" after insertion of the same on the end 22 of the rod 20 through the opening 15.

The assembly will then be completed by fitting the elastomeric membrane 24 on the rod 20 and inserting it into the seat 26, blocking the axial movement of the latter by means of a stop ring 25, which may be for example a Seeger ring.

Since the construction parts are minimal, like those in reciprocal movement, the linear actuator will require minimal maintenance and will guarantee a long service life.

The dimensions of the linear actuator 1 are minimal, making it suitable for any application, for example to move sliding doors or sliding door leaves, as better described below.

The simplicity of the linear actuator 1 will always guarantee the automatic closing/opening of the door or leaf from the open/closed position.

In a preferred but not exclusive embodiment of the invention, the closure element 14 may include means for controlling the air flow flowing in/out from the variable volume compartment 18", so as to control the force necessary to open the sliding door D and the closing speed thereof.

It is understood that the control means may also be configured only for one of the functions mentioned above, and in particular for controlling the force necessary for the passage of the cylindrical element 21 from the rest position to the working position or to control the speed of aspiration of the same towards the closed position, without thereby exceeding the scope of protection of the appended claims.

For this purpose, in general, a first and second line for the fluidic connection of the variable volume compartment 18" with the outside environment and valve means acting on them may be provided.

In the embodiment illustrated in FIGS. 1 to 5, a first fluid connecting line can be defined by a portion of the passing-through opening 15 and by the duct 19.

In this fluid connecting line upon the passage of the end cylinder 21 from the rest position to the working position, the air present in the compartment 18" will pass through the passing-through opening 15, entering the duct 19 through the opening 19" and going out through the exit 19'. It is evident that upon the aspiration of the end cylinder 21 from the working position to the rest position, the air will make the reverse passage, entering through the opening 19' to reach the expanding compartment 18".

On the other hand, the second fluid connecting line may be defined by the opening 15, by the seat 26 and by the annular gap 27 between the stop ring 25 and the rod 20.

In this fluid connecting line upon the passage of the end cylinder 21 from the rest position to the working position, the air present in the compartment 18" will reach the exit 27 upon the passage through the passing-through 15 and the seat 26, while upon the aspiration of the end cylinder 21 from the working position to the rest position, the air will do the reverse passage, entering through the annular gap 27 to reach the expanding compartment 18".

The valve means may be defined by the seat 26 which will act as a valve seat for the axial movement of the elastomeric membrane 24, which will act as a plug for the passing-through 15 upon the aspiration of the end cylinder 21 from the working position to the rest position and will rest against the stop ring 25 upon the passage of the end cylinder 21 from the rest position to the working position, in any case allowing the passage of the air.

In other words, during the opening of the sliding door D, the air present in the contracting compartment 18" will be free to pass both through the duct 19 and through the annular gap 27, while during the closing of the sliding door D the air will pass exclusively through the duct 19 to reach the expanding compartment 18".

By suitably dimensioning the above parts it will be possible to control both the force required to open the sliding door D and the closing speed thereof. In particular, the force required to open the sliding door D may be determined by the diameter of the end cylinder 21.

In order to adjust the latter, suitable adjustment means may be provided, for example an adjustment grain 30, for adjusting the passage section. In this way, it will be possible to adjust the inflow of air entering the duct 19 through the opening 19' upon the aspiration of the end cylinder 21 from the working position to the rest position, thus regulating the returning speed to the closed position of the sliding door D.

For this purpose, the adjustment grain 30 may have a control end 31' accessible from the outside by an operator and a working end 31" acting in the duct 19.

It is understood that the control means described above can be applied to any linear actuator, preferably of pneumatic type, without thereby departing from the scope of protection of the appended claims.

For example, the control means referred to above may be applied to a gas spring of a known type, or a gas spring of a known type may include these control means.

Figure 6:
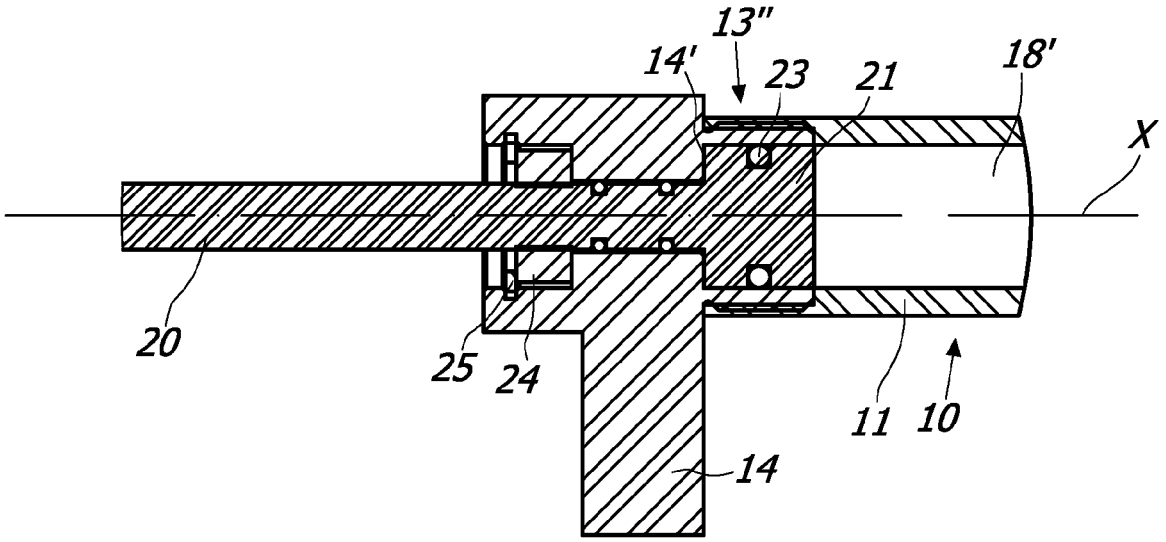
FIG. 6 is a sectional view of the end 13" of the tubular element 11 of a further embodiment of a linear actuator 1 having the end 22 in a distal position.
Figure 7:
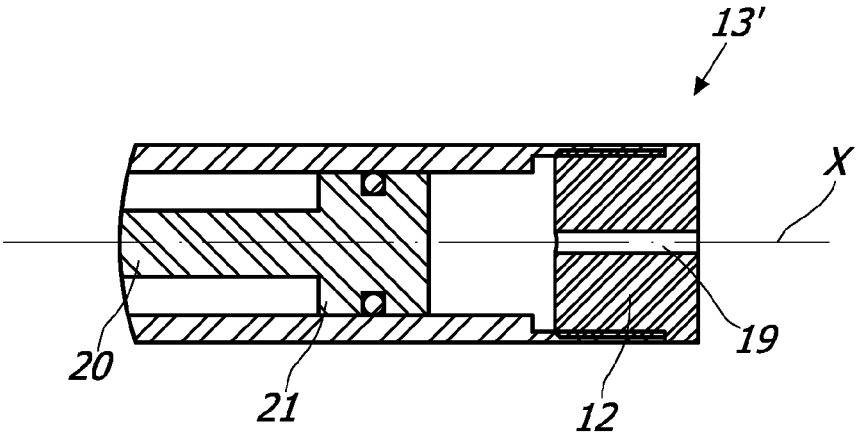
FIG. 7 is a sectional view of the end 13' of the tubular element 11 of the further embodiment of the linear actuator 1 of FIG. 6 having the end 22 in proximal position.
Figure 8A:
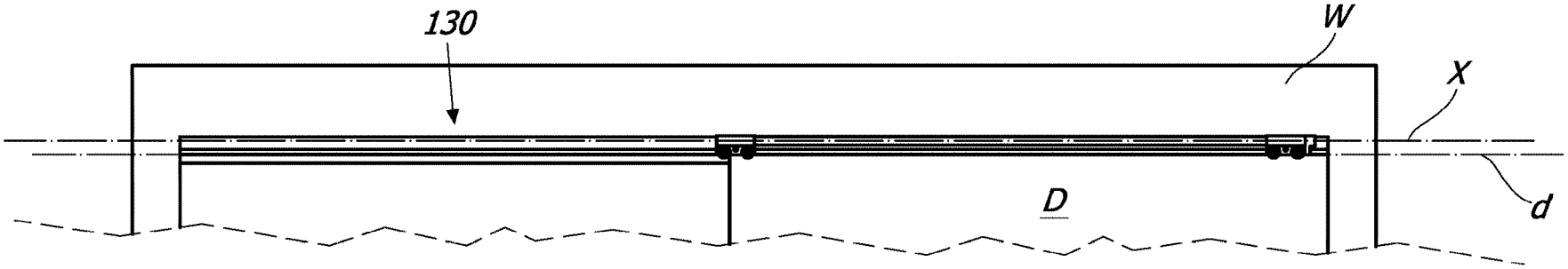
FIGS. 8*a* and 8*b* are enlarged schematic views of the embodiment of the system 100 of FIGS. 1*a* and 2*a,* showing the linear actuator 1 in the closed door position D and the open door position D.
Figure 8B:
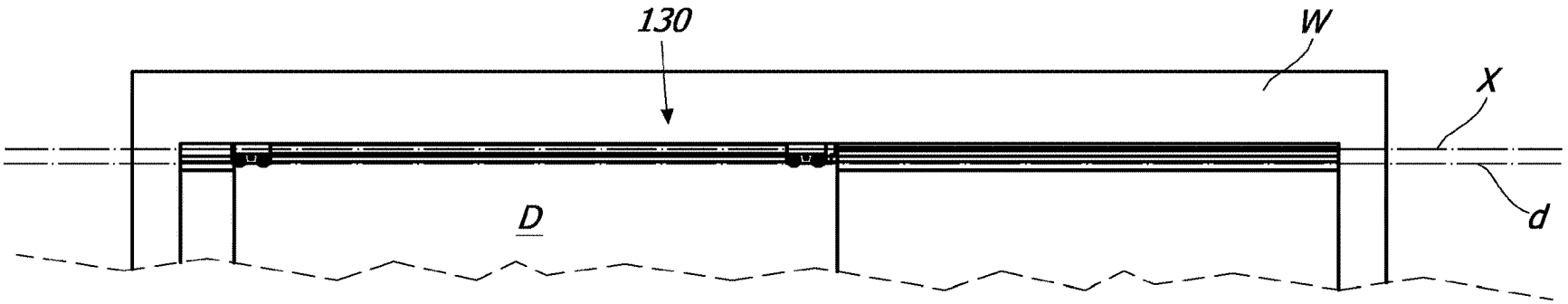
Figure 9A:
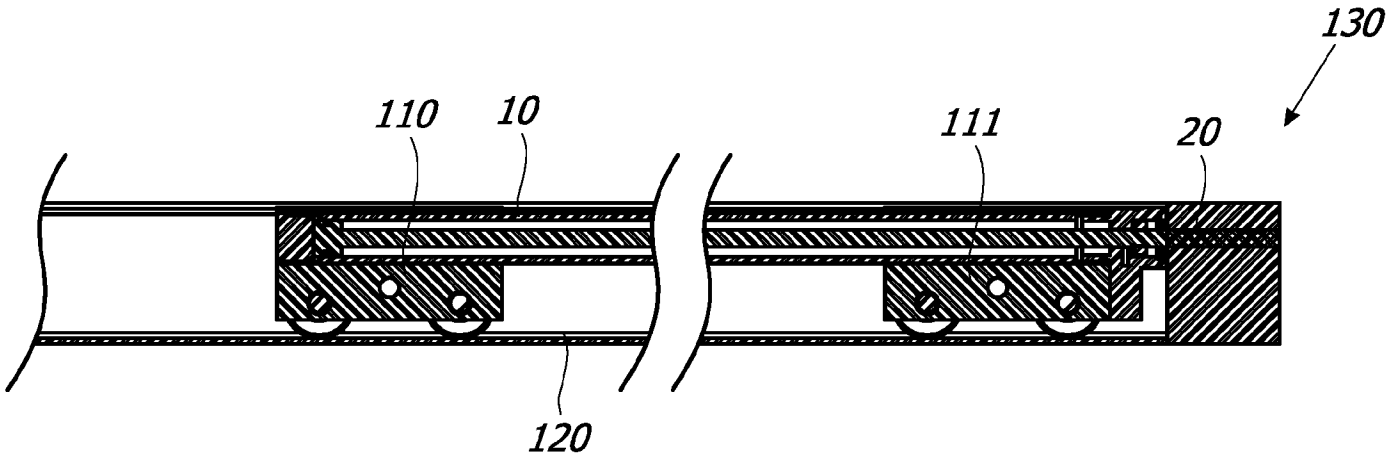
FIGS. 9*a* and 9*b* are sectional views of the embodiment of the linear actuator 1 illustrated in FIGS. 8*a* and 8*b* respectively in closed door position D and open door position D.
Figure 9B:
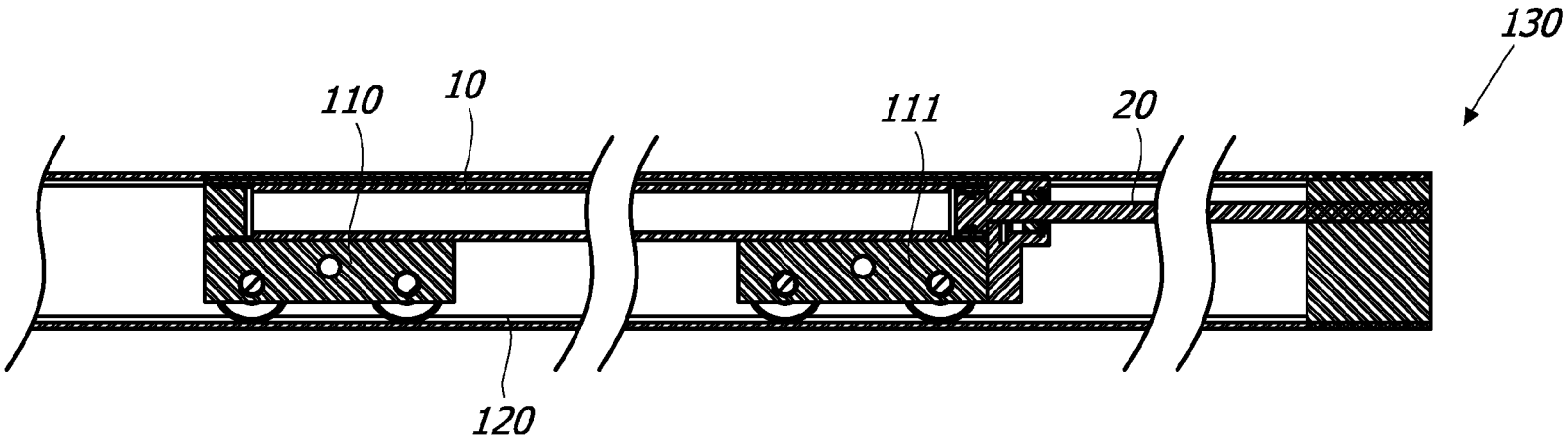

In a further embodiment of the linear actuator 1, illustrated for example in FIGS. 6 and 7, the rest position of the end 22 may correspond to the distal position from the jacket 10 thereof, as illustrated for example in FIG. 6, while the working position of the end 22 may correspond to the position proximal to the jacket 10 thereof, as illustrated for example in FIG. 7.

In this embodiment, the compartment 18" may be fluidically insulated and vacuum, while the compartment 18' can be in fluid connection with the outside environment to remain at atmospheric pressure.

For this purpose, when the end 22 is in the rest position, the end cylinder 21 of the rod 20 may be abutting against the closing element 14, and in particular against a stop wall 14' of the same, whereas when the end 22 is in the working position the end cylinder 21 of the rod 20 may remain spaced from the bottom wall 16 of the end cap 12 to free the passage opening 19" of the duct 19.

In this way, when the end 22 is in the rest position, the volume and the pressure of the compartment 18" are substantially zero.

This embodiment will work as opposed to that shown in FIGS. 1*b* to 5, and will therefore work in compression rather than in traction.

Once a user compresses the rod 20 from the extended rest position towards the retracted work position, in fact, the compartment 18" will suck the same rod bringing it back into the rest position.

From what has been described above, it is clear that the invention fulfils the intended objects.

The invention is susceptible of numerous modifications and variations, all within the inventive concept expressed in the appended claims. All the details may be replaced by other technically equivalent elements, and the materials may be different according to needs, without departing from the scope of the invention.

Although the invention has been described with particular reference to the accompanying figures, the reference numbers used in the description and claims are used to improve the intelligence of the invention and do not constitute any limitation to the claimed scope of protection.

The invention claimed is:

1. An actuator comprising:

a jacket defining an axis; and a rod having an end cylinder slidable in a reciprocal relation with said jacket along said axis between a rest position and a working position, wherein said end cylinder divides said jacket into a first and a second variable volume compartments, wherein said actuator is a linear actuator configured to move a closing element, wherein said first and said second variable volume compartments are fluidly independent from each other, wherein one of the first or the second variable volume compartments is fluidly insulated and under vacuum, the other one of the first or the second variable volume compartments being fluidly communicating with an outside environment to suck or discharge ambient air from or toward the outside environment, wherein, upon a passage of said end cylinder from said rest position to said working position, said one of said first or said second variable volume compartments expands, so as to suck said rod for returning said end cylinder from the working position to the rest position, wherein the actuator is configured to enable an air flow to enter or exit said other of said at least one first and said second variable volume compartments from the outside environment, wherein, upon the passage of said end cylinder from said rest position to said working position, said other of said first or said second variable volume compartments retracts by blowing off air toward the outside environment, and, upon sucking of said end cylinder from said working position to said rest position, the other one of said first or said second variable volume compartments expands by sucking the air from the outside environment, further comprising a control system that controls the air flow flowing in or out from said other of said first or said second variable volume compartments to control a force necessary for the passage of said end cylinder from said rest position to said working position and a suction speed thereof from said working position to said rest position, wherein said control system includes:

a first and a second fluid connecting line for fluid connection of said other one of said first and said second variable volume compartments with the outside environment; and a valve means selectively acting on one of said first or said second fluid connecting lines to open said first or said second fluid connecting lines upon the passage of said end cylinder from said rest position to said working position and to close said first or said second fluid connecting lines upon a reverse passage, so as to force the air to flow in said other one of said first or said second variable volume compartments through the other one of said first or said second fluid connecting lines.

2. The actuator according to claim 1, wherein a minimum volume of said one of said first or said second variable volume compartments is zero.

3. The actuator according to claim 1, wherein a pressure within said one of said first or said second variable volume compartments is zero.

4. The actuator according to claim 1, wherein said jacket includes a side wall and a pair of end walls, said end cylinder in said rest position being substantially in contact with one of said end walls.

5. The actuator according to claim 4, wherein said jacket includes a tubular element defining said side wall and an end cap engaging to said tubular element, said end cap including said one of said end walls, said rod and said tubular element being configured so that, upon a reciprocal coupling of said end cap to said tubular element, said one of said end walls and said end cylinder are in reciprocal contact engagement, so as to ensure that said one of said first or said second variable volume compartments is substantially under vacuum.

6. The actuator according to claim 1, wherein said rod further includes a second end opposite to said end cylinder and externally slidable with respect to said jacket along said axis between a position proximal to said jacket and corresponding to one of the rest or the working positions of said end cylinder, and a position distal therefrom and corresponding to the other one of the rest or working positions of said end cylinder.

7. The actuator according to claim 4, wherein one of said end walls is a bottom wall, the other one of said end walls being an opposite wall having a pass-through opening for passage of said rod, said one of said first or said second variable volume compartments including said bottom wall, a proximal position of the second end of said rod corresponding to the rest position of said end cylinder.

8. The actuator according to claim 1, wherein said control system include an adjusting device acting on said other one of said first or said second fluid connecting lines to adjust a flow passage section.

9. The actuator according to claim 8, wherein said other one of said first or said second fluid connecting lines includes at least one duct, said adjusting device including an adjusting screw having an operating end accessible from outside by an operator and a working end acting on said at least one duct.

10. The actuator according to claim 1, wherein said rod comprises a second end opposite to said end cylinder and external to said jacket and reciprocally slidable unitarily with said end cylinder between a position proximal to said jacket, corresponding to said rest position, and a distal position therefrom, corresponding to the working position, a suction of said end cylinder recalling said second end from the distal to the proximal position.

11. A system for automatically closing or opening an aperture, comprising:

at least one closing element movable between a closed position, wherein said aperture. is closed, and an open position, wherein said aperture is open;

a moving system adapted to move said at least one closing element, wherein said moving system comprises a linear actuator according to claim 1.

* * * * *